United States Patent [19]

Hasegawa et al.

[11] Patent Number: 4,475,505

[45] Date of Patent: Oct. 9, 1984

[54] SYSTEM FOR CONTROLLING IDLING RPM BY SYNCHRONOUS CONTROL OF SUPPLEMENTARY AIR

[75] Inventors: Shumpei Hasegawa, Niiza; Takashi Koumura, Iruma; Toshiyuki Mieno, Wako; Kiyoshi Oikawa, Niiza, all of Japan

[73] Assignee: Honda Motor Co., Ltd., Tokyo, Japan

[21] Appl. No.: 456,112

[22] Filed: Jan. 6, 1983

[30] Foreign Application Priority Data

Jan. 13, 1982 [JP] Japan ..... 57-3779

[51] Int. Cl.[3] ..... F02M 3/00

[52] U.S. Cl. ..... 123/339; 123/585

[58] Field of Search ..... 123/339, 585, 587, 480

[56] References Cited

U.S. PATENT DOCUMENTS 4,203,395 5/1980 Cromas et al. ..... 123/339
4,240,145 12/1980 Yano et al. ..... 123/585
4,301,780 11/1981 Hoshi ..... 123/480
4,387,429 6/1983 Yamauchi et al. ..... 123/480
4,406,262 9/1983 Ikeura ..... 123/339

*Primary Examiner*—Parshotam S. Lall
*Attorney, Agent, or Firm*—Arthur L. Lessler

[57] ABSTRACT

A system adapted to control a control valve for controlling the quantity of supplementary air being supplied to an internal combustion engine, in a feedback manner responsive to a difference between actual engine rpm and desired engine rpm at engine idle. The above control valve is opened in synchronism with a signal indicative of a predetermined rotational position of the engine. The system is also adapted to detect a total quantity of suction air including the supplementary air being supplied to the engine, in synchronism with the above predetermined rotational position signal, to supply a quantity of fuel corresponding to the detected total suction air quantity. Further, the system is adapted to start opening the control valve upon a lapse of such a period of time after each pulse of the predetermined engine rotational position signal has been inputted to the system that a proper value of the total suction air quantity can be detected at the time of inputting of the next pulse of the same signal to the system.

6 Claims, 7 Drawing Figures

SYSTEM FOR CONTROLLING IDLING RPM BY SYNCHRONOUS CONTROL OF SUPPLEMENTARY AIR

BACKGROUND OF THE INVENTION

This invention relates to an idling rpm feedback control system for internal combustion engines, and more particularly to an idling rpm feedback control system which uses an on-off type valve for control of the quantity of supplementary air and is adapted to supply supplementary air to the engine in synchronism with a signal indicative of a top dead center of the engine.

An idling rpm feedback control system is conventionally known which is adapted to set the engine rpm at a desired value of engine rpm depending upon a load on the engine at engine idle, detect the difference between the desired engine rpm and actual engine rpm and control the supply of supplementary air to the engine in response to the detected difference so as to make the same difference zero, to thereby maintain the actual engine rpm at the desired value.

In such an idling rpm feedback control system as disclosed in the above publication, it is also known to use an on-off type control valve for control of the quantity of supplementary air and to control the valve by varying the pulse duty cycle of a drive signal therefor. Some idling rpm feedback control systems of this kind are combined with fuel injection systems which are adapted to detect the quantity of suction air being supplied to the engine and electronically control the fuel injection quantity in response to the detected suction air quantity. According to such fuel injection systems, if a parameter representative of the suction air quantity such as intake pipe pressure largely fluctuates, it is difficult to detect the value of the parameter with accuracy and therefore also determine a correct value of the required suction air quantity, making it difficult to supply a proper quantity of fuel to the engine.

To overcome this disadvantage, a method has been proposed which comprises setting the pulse duty cycle of the drive signal for the supplementary air quantity control valve at a frequency value higher than the cycle of fluctuations of the pressure of the suction air or a like parameter so as to reduce the flucutuations of the suction air pressure to be caused by the introduction of supplementary air into the intake pipe. However, according to this proposed method, the frequency at which the supplementary air quantity control valve is opened and closed is rather high, which necessitates designing the valve so as to impart sufficient endurance thereto.

SUMMARY OF THE INVENTION

It is an object of the invention to provide an idling rpm feedback control system for use with an internal combustion engine, in which the opening frequency of the supplementary air quantity control valve is reduced by opening the valve in synchronism with a signal indicative of a predetermined rotational position of the engine while supplying proper quantities of supplementary air to the engine.

It is a further object of the invention to provide an idling rpm feedback control system for use with an internal combustion engine, in which the total quantity of suction air inclusive of the supplementary air is detected in synchronism with the above predetermined engine rotational position signal, with high accuracy, to ensure supply of proper quantities of fuel to the engine, which correspond to detected values of the total suction air quantity.

It is a still further object of the invention to provide an idling rpm feedback control system for use with an internal combustion engine, in which the valve opening timing of the supplementary air quantity control valve is controlled with respect to generation of the predetermined engine rotational position signal so as to make the phase of fluctuations of a suction air quantity parameter relative to the same signal, whereby a central value of the suction air parameter, which exactly correspond to an actual quantity of the supplementary air, are always obtained to enable supplying proper quantities of fuel to the engine.

An idling rpm feedback control system according to the invention comprises: an air passage having one end communicating with an intake passage of the engine at a location downstream of a throttle valve therein and another end communicating with the atmosphere; a control valve for regulating the quantity of supplementary air being supplied to the engine through the air passage; valve control means for controlling the control valve in a feedback manner responsive to the difference between actual engine rpm and desired engine rpm; fuel supply control means for supplying the engine with fuel in quantities corresponding to total quantities of suction air inclusive of the supplementary air and being supplied to the engine; and sensor means for detecting a predetermined rotational position of the engine and supplying a signal indicative of the detected predetermined engine rotational position to the valve control means. The valve control means is operable to open the control valve in synchronism with the predetermined engine rotational position signal.

The fuel supply control means includes second sensor means for detecting a parameter representing a total quantity of suction air inclusive of the supplementary air and being supplied to the engine. Preferably, the second sensor means is adapted to detect the above parameter in synchronism with the predetermined engine rotational position signal.

Further preferably, the above valve control means is adapted to start opening the control valve upon a lapse of such a period of time after each pulse of the predetermined engine rotational position signal has been supplied to the valve control means, that the second sensor means can detect a central value of the above parameter at the time of inputting of the immediately following pulse of the same signal to the valve control means.

The above and other objects, features and advantages of the invention will be more apparent from the ensuing detailed description taken in connection with the accompanying drawings:

DETAILED DESCRIPTION

The invention will now be described in detail with reference to the accompanying drawings.

Figure 1:
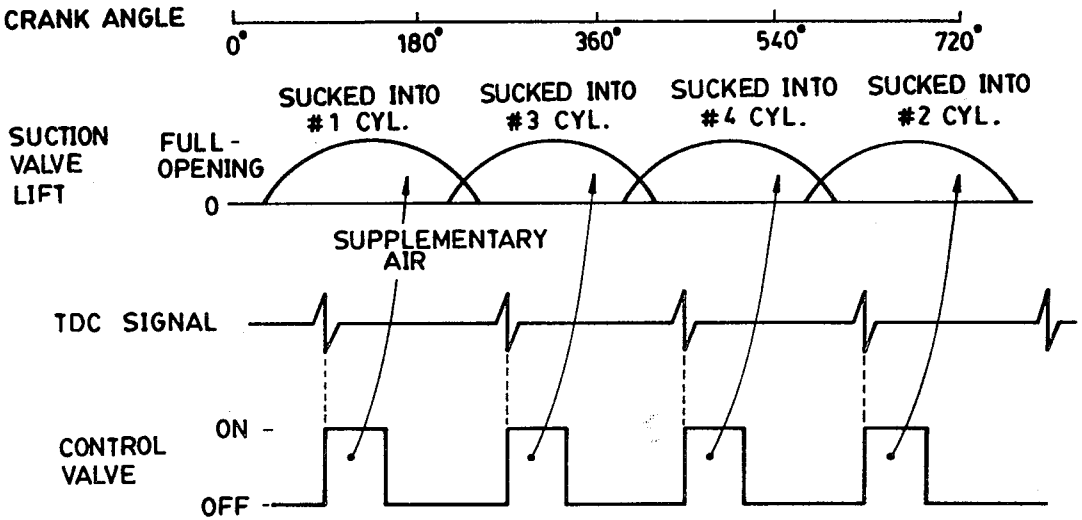
FIG. 1 is a timing chart showing a manner of supplying supplementary air to the engine in synchronism with a signal indicative of a top dead center of the engine, applicable to the system of the present invention.

Referring first to FIG. 1, a manner of supplying supplementary air to the engine is shown, which is applicable to the system of the invention. A signal indicative of the top dead center of a piston of the engine (hereinafter called "a TDC signal") may be used as a signal indicative of a predetermined rotational position of the engine. Therefore, a pulse of the TDC signal is generated at each suction stroke of the engine. A control valve for control of the quantity of supplementary air (hereinafter merely called "a control valve") is opened in synchronism with generation of each pulse of the above TDC signal. It should be noted that according to the supplementary air supplying manner in FIG. 1, the control valve is opened only one time each time a pulse of the TDC signal is generated, that is, each time the engine goes through each suction stroke. This manner reduces the frequency of opening and closing the control valve to thereby lengthen the effective life of the control valve.

Figure 2:
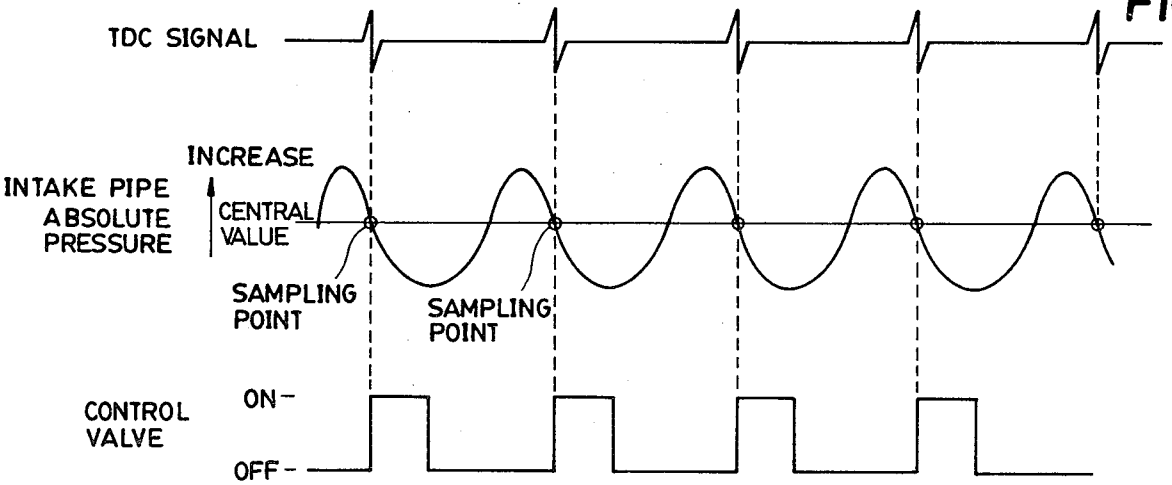
FIG. 2 is a timing chart showing a manner of detecting a parameter of the total suction air quantity, applicable to the system of the present invention.
Figure 3:
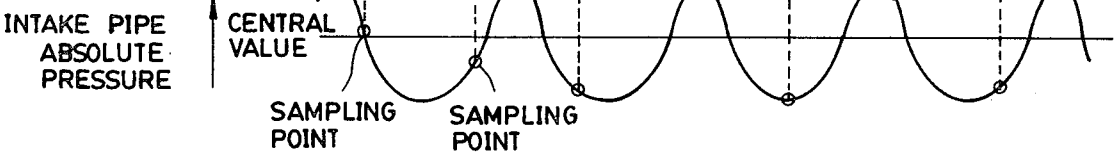
FIG. 3 is a timing chart showing a manner of detecting the same parameter at a constant time interval optionally selected.

Referring next to FIG. 2, there is shown a manner of detecting absolute pressure in the intake pipe of the engine as a parameter representative of the total quantity of suction air being supplied to the engine, which is also applicable to the system of the invention. On the other hand, FIG. 3 shows a manner of detecting the intake pipe absolute pressure at a constant time interval optionally selected, irrespective of fluctuations in the intake pipe absolute pressure. According to the manner of FIG. 3, the intake pipe absolute pressure is detected in synchronism with generation of a sampling signal having a constant pulse repetition period. The sampling signal cannot correspond in phase to fluctuations in the intake pipe absolute pressure, making it impossible to detect a central value of the intake pipe absolute pressure which is correctly indicative of the actual total quantity of the suction air. On the other hand, if the control valve is operated in synchronism with generation of the TDC signal for controlling the supply of supplementary air, as shown in the manner of FIG. 1, the fluctuations of the intake pipe absolute pressure nearly correspond in repetition period to the TDC signal, as shown in FIG. 2. The present invention is based upon this recognition, and according to the invention, the intake pipe absolute pressure is detected in synchronism with generation of the TDC signal, that is, at a substantially constant phase point of the fluctuation waves of the intake pipe absolute pressure, thus obtaining central values of the same pressure exactly corresponding to actual total suction air quantities. The TDC signal may be such a signal that each pulse of the TDC signal is generated at a predetermined crank angle of the engine which differs in phase from a proper top dead center of the crankshaft. As a consequence, proper amounts of fuel can be supplied to the engine, which exactly correspond to actual total suction air quantities, preventing unstable idling operation of the engine which would otherwise be caused by fluctuations in the fuel supply quantity.

Figure 4:
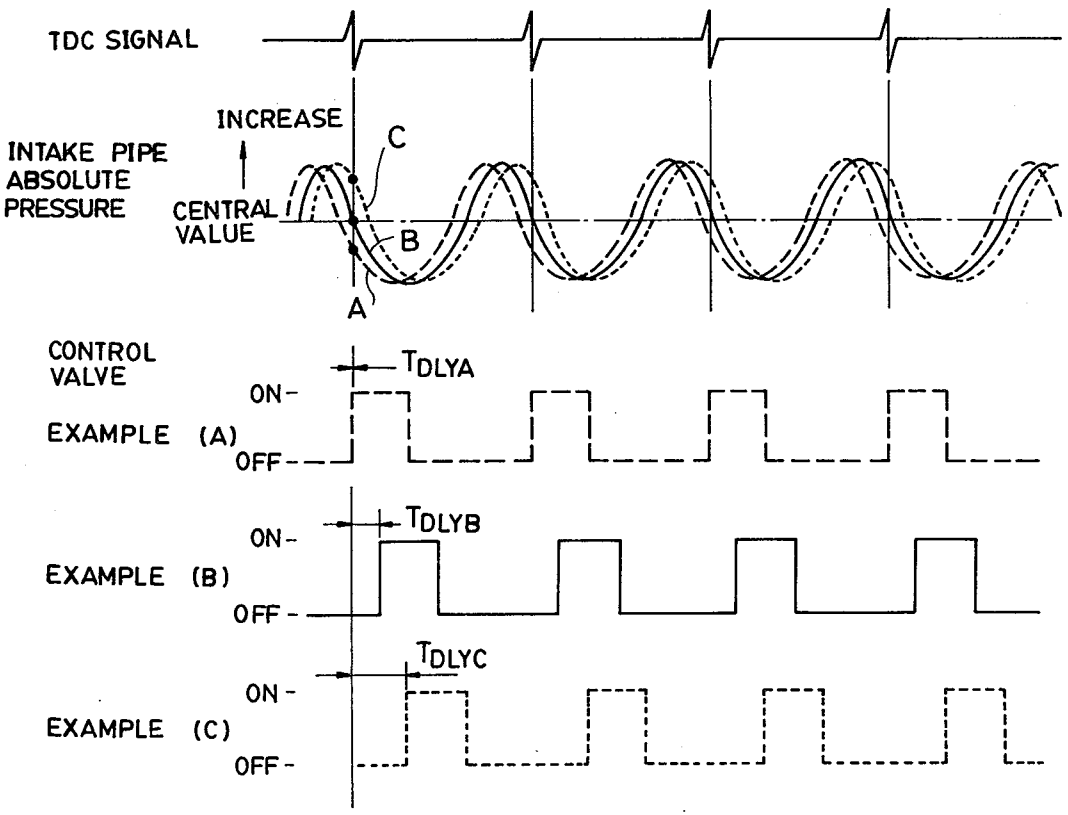
FIG. 4 is a timing chart showing a manner of starting opening the supply of supplementary air with a time delay with respect to generation of the top dead center signal, applicable to the system of the present invention.

Further, when supplementary air is supplied to the engine, the cycle of fluctuations of the intake pipe absolute pressure can deviate in phase from generation of pulses of the TDC signal, depending upon the timing of initiation of the opening of the control valve, that is, the timing of initiation of the supply of supplementary air, which causes variations in the timing of obtaining central values of the intake pipe absolute pressure exactly corresponding to the total suction air quantities. If the intake pipe absolute pressure is detected always at a constant time with respect to generation of the TDC signal pulses, irrespective of such phase deviation of the fluctuations of the intake pipe absolute pressure, actually detected values of the intake pipe absolute pressure can be higher or lower than respective central values of same, due to the above phase deviation. FIG. 4 shows methods of detecting the intake pipe absolute pressure, in which the same pressure is detected just upon generation of each pulse of the TDC signal. According to the engine to which the methods of FIG. 4 are applied, if the control valve is opened upon a lapse of an optional period of time TDLY C after generation of each TDC signal pulse as shown in the example C in FIG. 4, the resulting detected value of the intake pipe absolute pressure is higher than the actual central value, and as a consequence the system judges that suction air has been supplied to the engine in greater quantities than the actual quantities, and accordingly supplies the engine with larger quantities of fuel than actually required, resulting in a too rich mixture being supplied to the engine. On the contrary, if the control valve is opened immediately upon generation of each TDC signal pulse as in the example A, the resulting detected value of the intake pipe absolute pressure is lower than the actual central value, resulting in a too lean mixture being supplied to the engine. In view of the above disadvantages, according to the invention, as shown in the example B in FIG. 4, the value of a predetermined delay coefficient is determined in dependence upon the configuration of the intake pipe of the engine applied, and the timing of opening of the control valve, i.e. the timing of supply of supplementary air is delayed by a period of time TDLY B corresponding to the determined coefficient value with respect to generation of each TDC signal pulse so as to always make the phase of the fluctuating cycle of the intake pipe absolute pressure constant relative to the timing of generation of the TDC signal pulses, thus making it possible to positively detect central values of the absolute pressure. In this manner, according to the invention, fuel can be always supplied to the engine in proper quantities exactly corresponding to quantities of supplementary air, for instance, in quantities corresponding to a theoretical air/fuel ratio, to ensure accurate and stable control of the idling rpm of the engine.

Figure 5:
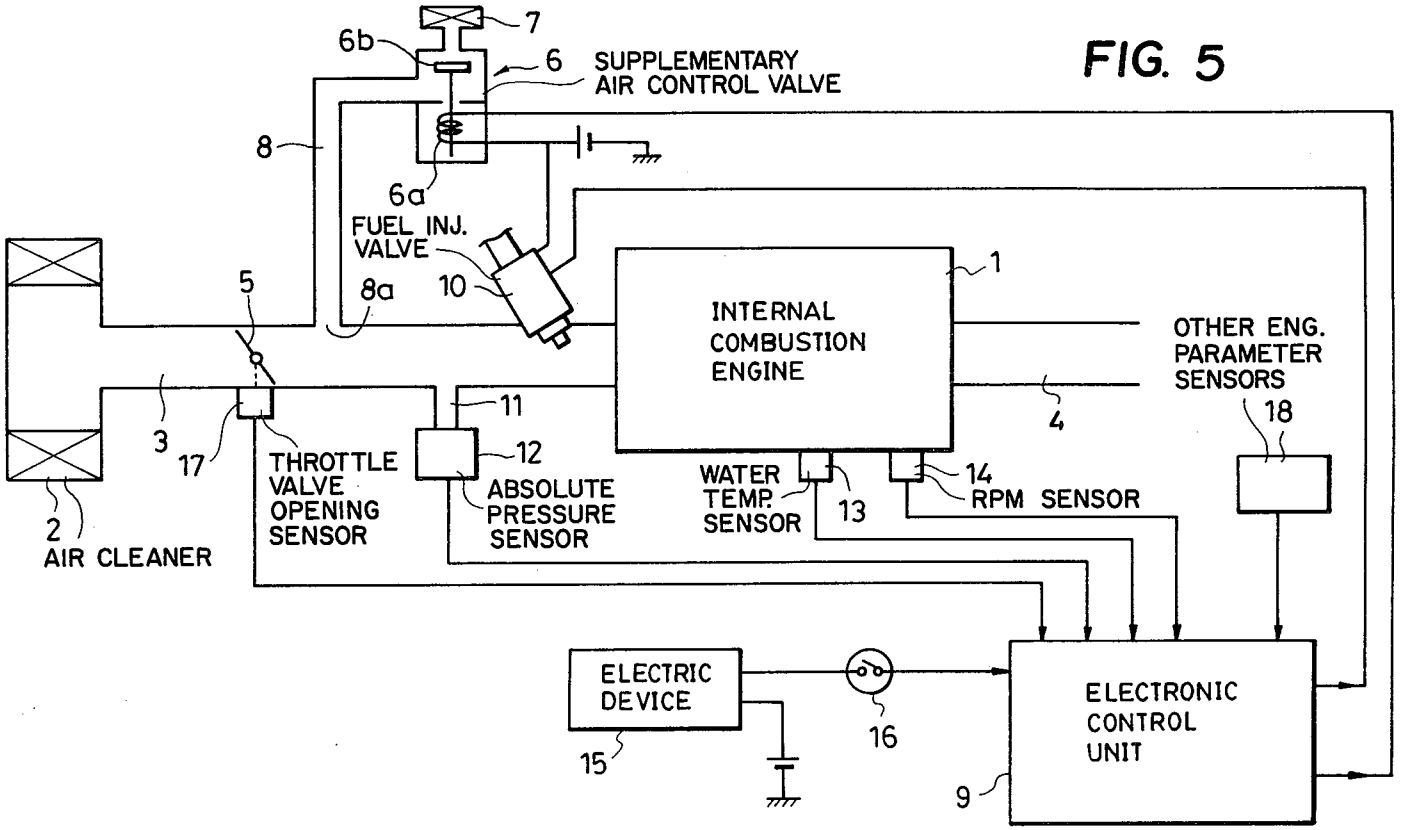
FIG. 5 is a block diagram illustrating the whole construction of the system of the present invention.

FIG. 5 schematically illustrates an idling rpm feedback control system according to the invention. In the figure, reference numeral 1 designates an internal combustion engine which may be a four-cylinder type, and to which are connected an intake pipe 3 with an air cleaner 2 mounted at its open end and an exhaust pipe 4, at an intake side and an exhaust side of the engine, respectively. A throttle valve 5 is arranged within the intake pipe 3, and an air passage 8 opens at its one end 8*a* in the intake pipe 3 at a location downstream of the throttle valve 5. The air passage 8 has its other end communicating with the atmosphere and provided with an air cleaner 7. A control valve 6 is arranged across the air passage 8 to control the quantity of supplementary air being supplied to the engine. This control valve 6 is a normally closed type and comprises a solenoid 6*a* and a valve 6*b* disposed to open the air passage 8 when the solenoid 6*a* is energized. The solenoid 6*a* is electrically connected to an electronic control unit (hereinafter called "ECU") 9.

A fuel injection valve 10 is arranged in a manner projected into the intake pipe 3 at a location between the engine 1 and the open end 8*a* of the air passage 8, and is connected to a fuel pump, not shown, and also electrically connected to the ECU 9.

A throttle valve opening sensor 17 is mounted on the throttle valve 5, and an absolute pressure sensor 12 is provided in communication with the interior of the intake pipe 3 through a conduit 11 at a location downstream of the open end 8*a* of the air passage 8, while an engine cooling water temperature sensor 13 and an engine rpm sensor 14 are both mounted on the body of the engine 1. All the sensors are electrically connected to the ECU 9. Reference numeral 15 designates electric devices such as head lamps and an air conditioner, which are electrically connected to the ECU 9 by way of a switch 16. Reference numeral 18 denotes other engine parameter sensors such as an atmospheric pressure sensor, which are also electrically connected to the ECU 9.

The idling rpm feedback control system constructed above operates as follows: The engine rpm sensor 14 generates a TDC signal and supplies same to the ECU 9. The ECU 9 operates on the input TDC signal to read various engine parameter values detected by the throttle valve opening sensor 17, the absolute pressure sensor 12, the cooling water temperature sensor 13 and other engine parameter sensors 18. Then, the ECU 9 determines operating conditions of the engine 1 and electrical loads thereon on the basis of the read values of these engine parameters and a signal indicative of electrical loads on the engine supplied to the ECU 9 from the electric devices 15, and then calculates a desired quantity of fuel to be supplied to the engine 1. The ECU 9 then determines a corresponding valve opening period of the fuel injection valve 10, and also a desired quantity of supplementary air to be supplied to the engine 1, that is, a desired valve opening period of the control valve 6 as well as a desired period of time by which the opening of the control valve 6 is to be delayed from generation of each TDC signal pulse, on the basis of the determined operating conditions and electrical loads. Then, the ECU 9 supplies driving pulses corresponding to the calculated values to the fuel injection valve 10 and the control valve 6.

The control valve 6 is energized by each of its driving pulses to open for a period of time corresponding to its calculated valve opening period value and after a lapse of a period of time from generation of a TDC signal pulse, which corresponds to the valve opening delaying period value calculated, to open the air passage 8 so that a quantity of supplementary air corresponding to the calculated valve opening period value is supplied to the engine 1 through the air passage 8 and the intake pipe 3.

The fuel injection valve 10 is energized by each of its driving pulses to open for a period of time corresponding to its calculated valve opening period value to inject fuel into the intake pipe 3. The ECU 9 operates so as to supply an air/fuel mixture having a predetermined air/fuel ratio, e.g. a theoretical air/fuel ratio, to the engine 1.

When the valve opening period of the control valve 6 is increased to increase the quantity of supplementary air, an increased quantity of the mixture is supplied to the engine 1 to increase the engine output, resulting in an increase in the engine rpm, whereas a decrease in the above valve opening period causes a corresponding decrease in the quantity of the mixture, resulting in a decrease in the engine rpm. In this manner, the engine rpm is controlled by controlling the quantity of supplementary air or the valve opening period of the control valve 6.

Figure 6:
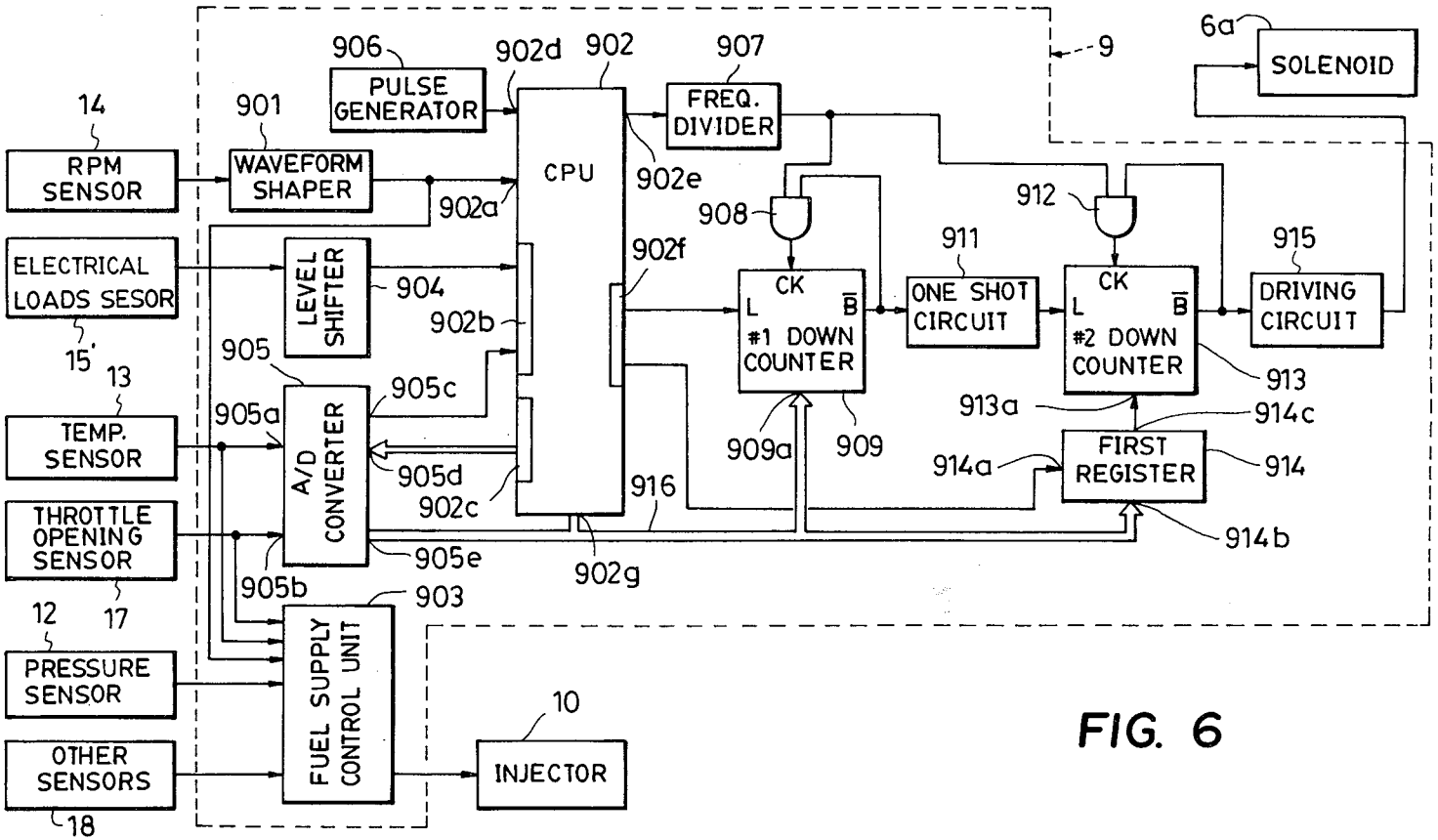
FIG. 6 is a block diagram illustrating an electrical circuit incorporated within the electronic control unit (ECU) appearing in FIG. 1.

Next, the electrical circuit in the ECU 9 will now be described by referring to FIG. 6 which illustrates an embodiment thereof.

The engine rpm sensor 14 in FIG. 5 is connected to an input terminal 902*a* of a one chip CPU (hereinafter merely called "CPU") 902 by way of a waveform shaper 901, both provided in the ECU 9. Reference numeral 15' represents sensor means for detecting the electrical loads of the electric devices 15 in FIG. 5, which are connected to respective ones of a group of further input terminals 902*b* of the CPU 902 by way of a level shifter 904 in the ECU 9. The water temperature sensor 13 and the throttle valve opening sensor 17 are connected, respectively, to input terminals 905*a* and 905*b* of an analog-to-digital converter 905 and are also both connected to the input of a fuel supply control unit 903. The analog-to-digital converter 905 has an output terminal 905*c* connected to the input terminals 902*b* of the CPU 902 and a group of further input terminals 905*d* connected to a group of output terminals 902*c* of the CPU 902. A pulse generator 906 is connected to another input terminal 902*d* of the CPU 902 which in turn has an output terminal 902*e* connected to AND circuits 908 and 912 at their one input terminals, by way of a frequency divider 907. The AND circuit 908 has its output connected to a clock pulse input terminal CK of a first down counter 909. The AND circuit 908 has its other input terminal connected to a borrow output terminal $\overline{B}$ of the first down counter 909 which terminal is further connected to a load input terminal L of a second down counter 913 by way of a one shot circuit 911. The first down counter 909 has its load input terminal L connected to a first one of another group of output terminals 902*f* of the CPU 902. The AND circuit 912 has its output connected to a clock pulse input terminal CK of the second down counter 913, and its other input terminal to a borrow output terminal $\overline{B}$ of the same counter 913, respectively. The borrow output terminal $\overline{B}$ of the second down counter 913 is also connected to the solenoid 6*a* of the control valve 6 in FIG. 4 by way of a solenoid driving circuit 915. A second one of the input terminals 902*f* of the CPU 902 is connected to an input terminal 914*a* of a first register 914 which in turn has its output connected to an input terminal 913*a* of the second down counter 913.

The analog-to-digital converter 905, the CPU 902, the first regulator 914 and the down counter 909 are connected together by way of a data bus 916, respectively, at an output terminal 905*e*, an input and output terminal 902g, an input terminal 914b and an input terminal 909a.

Connected to the fuel supply control unit 903 are the intake air pressure or absolute pressure sensor 12 and the other engine parameter sensor 18 such as an atmsopheric pressure sensor, all appearing in FIG. 5. The output of the fuel supply control unit 903 is connected to the fuel injection valve 10 in FIG. 5.

The electrical circuit of the ECU 9 constructed above operates as follows: An output signal from the engine rpm sensor 14 is supplied to the ECU 9 as a signal indicative of engine rpm Ne as well as a signal indicative of a top dead center of the engine 1, where it is subjected to waveform shaping by the waveform shaper 901 and then supplied to the CPU 902 and the fuel supply control unit 903. Upon being supplied with this top dead center signal, the CPU 902 generates a chip selecting signal, a channel selecting signal, an analog-to-digital conversion starting signal, etc. the latter commanding the analog-to-digital converter 905 to convert analog signals such as the engine cooling water temperature signal and the throttle valve opening signal from the cooling water temperature sensor 13 and the throttle valve opening sensor 17 into corresponding digital signals. The digital signals indicative of the cooling water temperature and the throttle valve opening from the converter 905 are supplied as data signals to the CPU 902 via the data bus 912. Upon completion of inputting of one of these digital signals to the CPU 902, the analog-to-digital converter 905 generates at its output terminal 905c a signal indicative of termination of the analog-to-digital conversion of the digital signal and applies same to the CPU 902. The same process is once again effected to cause inputting of the other digital signal to the CPU 902. Further, an electrical load-indicative signal from the electrical load sensor means 15' has its voltage level shifted to a predetermined level by the level shifter 904 and then applied to the CPU 902. The CPU 902 operates on these input data signals, i.e. the engine rpm signal, the electrical load signal, the engine water temperature signal and the throttle valve opening signal to arithmetically calculate the valve opening delaying period TDLY and valve opening period TOUT of the control valve 6.

Figure 7:
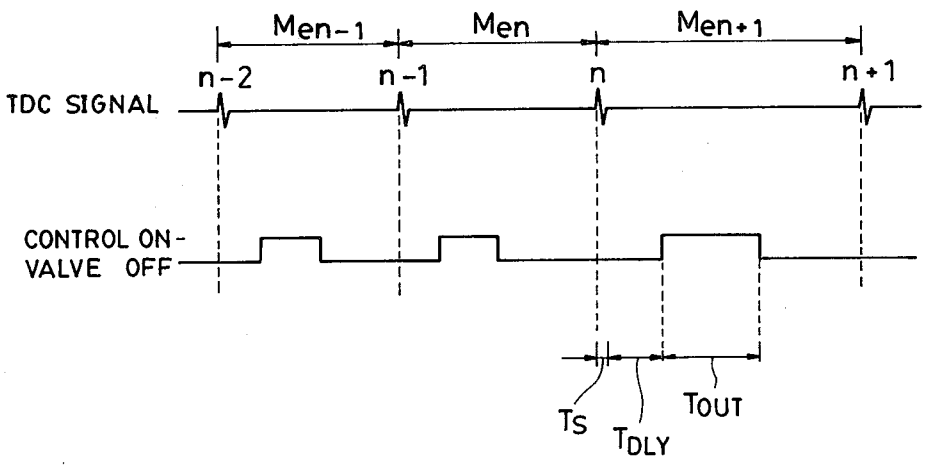
FIG. 7 is a timing chart showing the timing relationship between generation of the top dead center signal and opening of the supplementary air quantity control valve.

The manner of calculating the above periods will now be described in detail with reference to FIG. 7. In FIG. 7, when an nth pulse of the TDC signal is inputted to the CPU 902, operations are carried out within a period of time Ts from the above inputting of the TDC signal pulse, which include reading of the aforementioned data signals into the CPU 902, arithmetic calculations of the valve opening delaying period TDLY and valve opening period TOUT of the control valve 6 and supply of the resulting calculated values from the CPU 902 to the first down counter 909 and the first register 914. After these operations are over, the control valve 6 is opened upon a lapse of the calculated valve opening delaying period TDLY for the calculated period of time TOUT. As noted above, exactly saying, the valve opening delaying period applied after the inputting of each TDC signal pulse is equal to Ts+TDLY. The period Ts consisting of the data reading period and the arithmetic calculating period is has a nearly constant value and is applied upon inputting of each pulse of the TDC signal to the CPU 902 at substantially constant intervals of time. Therefore, the valve opening delaying period TDLY alone is calculated upon inputting of each pulse of the TDC signal.

The valve opening delaying period TDLY and the valve opening period TOUT can be determined by the following equations:

$$TDLY = DDLY/100 \times Men \quad (1)$$

$$TOUT = DOUT/100 \times Men + To \quad (2)$$

In the above equations, Men represents a time interval from inputting of an (n−1)th pulse of the TDC signal to inputting of the nth pulse of same, and the value of Men is proportional to the reciprocal of engine rpm Ne, that is, it decreases as the engine rpm Ne increases. As expressed by the equations (1) and (2), the valve opening delaying period TDLY and the valve opening period TOUT are determined by multiplying the value of Me by constants DDLY and DOUT (in percentage), respectively. Although the calculations of the values TDLY and TOUT applicable after inputting of the present nth pulse of the TDC signal should be made by using the corresponding time interval Men+1 to obtain exact calculated values, the value of Men+1 is not yet known at the time of calculating the present values TDLY and TOUT and the value Men+1 is nearly equal to the value of Men applied in the previous loop. Therefore, the value of Men is used for calculating the values TDLY and TOUT.

In the equation (1), the coefficient DDLY is a constant which has its value dependent upon the configuration of the intake pipe of an engine applied, etc. and experimentally determined for each engine applied. It is set at a value so as to make the phase of the fluctuating cycle of the intake pipe absolute pressure always constant with respect to generation of each pulse of the TDC signal, for instance, it is set at 25 percent.

In the equation (2), the coefficient DOUT is a variable which has its value determined upon inputting of each pulse of the TDC signal as a function of engine rpm, engine cooling water temperature, electrical loads, etc. It is set to appropriate values so as to control the idling rpm to a value appropriate for the engine load at idle. To is a constant representing a dead period of time corresponding to the response lag of the control valve 6, or a like factor, and is set at 7 ms, for instance.

Data indicative of the values TDLY and TOUT calculated by the equations (1) and (2) are generated from the CPU 902 and loaded into the first down counter 909 and the first register 914 through the data bus 916 upon inputting of a reading command signal to their respective input terminals 909a and 914a. That is, the valve opening delaying period TDLY is loaded into the first down counter 909, and the valve opening period TOUT into the first register 914, respectively.

Clock pulses generated by the pulse generator 906 are used as a reference signal for control of the operation of the CPU 902, while they are subjected to frequency division into a suitable frequence by the frequency divider 907, and then applied to the AND circuits 908 and 912 at their one input terminals.

The CPU 902 applies a starting command signal to the first down counter 909 at its input terminal L upon a lapse of the period Ts after inputting of each pulse of the TDC signal to the CPU 902. Upon being supplied with this starting command signal, the first down counter 909 is loaded with the calculated valve opening delaying period value TDLY and at the same time generates a high level output of 1 at its borrow output terminal B and applies it to the AND circuit 908 at its other input terminal.

As long as the AND circuit 908 has its other input terminal supplied with the above high level output of 1, it allows clock pulses applied to its one input terminal to be applied to the first down counter 909 at its clock pulse input terminal CK. The first down counter 909 counts clock pulses until the count reaches a value corresponding to the calculated value of the valve opening delaying period TDLY. Upon counting the above value, the first down counter 909 generates a low level output of 0 through its borrow output terminal $\overline{B}$ to close the AND circuit 908 to cause interruption of application of clock pulses to the first down counter 909.

The one shot circuit 911 applies a starting command pulse to the second down counter 913 at its load input terminal L each time it is supplied with the above low level output from the first down counter 909. That is, the above starting command pulse is applied to the second down counter 913 upon completion of the counting of clock pulses corresponding in number to the calculated valve opening delayed period TDLY by the first down counter 909.

Upon being supplied with the starting command pulse from the one shot circuit 911, the second down counter 913 is loaded with the calculated valve opening period value TOUT from the first register 914, and at the same time generates a high level output of 1 at its borrow output terminal $\overline{B}$ and applies it to the AND circuit 912 at its outer input terminal and also to the solenoid driving circuit 915. The solenoid driving circuit 915 operates to cause energization of the solenoid 6*a* of the control valve 6 in FIG. 4 for supply of supplementary air to the engine 1 as long as it is supplied with the above high level signal of 1 from the second down counter 913.

While the AND circuit 912 has its other input terminal supplied with the high level signal of 1, it allows clock pulses applied to its one input terminal to be applied to the clock pulse input terminal CK of the second down counter 913. In a manner similar to the operation of the first down counter 909, the second down counter 913 continuously generates a high level output of 1 through its borrow output terminal $\overline{B}$ until it is supplied with clock pulses corresponding in number to the calculated valve opening period TOUT, and upon counting clock pulses corresponding in number to the value TOUT, it generates a low level output of 0 through the same terminal $\overline{B}$ to cause the solenoid driving circuit 915 to deenergize the solenoid 6*a* of the control valve 6. At the same time, the above low level output of the second down counter 913 is also supplied to the AND circuit 912 to interrupt the application of clock pulses to the second down counter 913.

On the other hand, in the fuel supply control unit 903, each time it is supplied with a pulse of the TDC signal from the engine rpm sensor 14, it carries out reading detected engine parameter values from the absolute pressure sensor 12, the engine cooling water temperature sensor 13, the throttle valve opening sensor 17, and the other engine parameter sensors 18 such as the atmospheric pressure sensor and calculates a fuel supply quantity corresponding to the operating condition of the engine.

Since as set forth above reading of various engine parameter signals into the ECU is effected each time a TDC signal pulse is inputted thereto, that is, in synchronism with generation of each TDC signal pulse, and preferably the initiation of the supply of supplementary air to the engine is delayed with the valve opening delaying period TDLY so as to keep the phase of the fluctuating cycle of the intake pipe pressure constant with respect to generation of each TDC signal pulse, values of the intake pipe absolute pressure detected and read always represent central values of same exactly corresponding to total suction air quantities being supplied to the engine. Consequently, accurate values of the fuel supply quantity can be calculated.

In summary, according to the invention, the following excellent results are available:

a. Since the supplementary air quantity control valve is opened in synchronism with a predetermined engine rotational position signal so as to supply a required quantity of supplementary air to the engine, the frequency of opening and closing of the control valve is largely reduced to achieve a longer effective life of the valve.

b. By virtue of the feature that the suction air quantity detecting means is adapted to detect the total suction air quantity of synchronism with the above predetermined engine rotational position signal, detection of the same quantity can be effected with high accuracy, in spite of fluctuations in the intake pipe pressure, making it possible to supply a proper amount of fuel to the engine for prevention of unstable idling operation of same.

c. Since the opening of the control valve is initiated after a lapse of a suitable period of time from generation or inputting of the predetermined engine rotational position signal, the phase of the fluctuating cycle of a suction air quantity parameter such as the intake pipe absolute pressure can be maintained constant with respect to generation of the predetermined engine rotational position signal, making it possible to always obtain central values of the suction air quantity parameter. Therefore, proper amounts of fuel can be supplied to the engine to achieve accurate and stable feedback control of the idling rpm of the engine.

What is claimed is:

1. An idling rpm feedback control system for an internal combustion engine having an intake passage, and a throttle valve arranged in said intake passage, comprising:

an air passage having one end communicating with said intake passage at a location downstream of said throttle valve and another end communicating with the atmosphere, respectively;

an on-off type electromagnetic control valve arranged across said air passage to regulate the quantity of suction air being supplied to said engine through said air passage;

valve control means for controlling said control valve in a feedback manner responsive to the difference between actual rpm of the engine and desired rpm of the engine;

fuel supply control means for supplying said engine with fuel in quantities corresponding to total quantities of suction air inclusive of said supplementary air; and sensor means for detecting a predetermined rotational position of said engine and supplying a signal indicative of the detected predetermined engine rotational position to said valve control means;

said valve control means being operable to open said control valve in synchronism with said predetermined engine rotational position signal, in a manner such that said control valve is opened one time each time a pulse of said predetermined engine rotational position signal is supplied thereto.

2. The idling rpm feedback control system as claimed in claim 1, wherein said fuel supply control means includes second senser means for detecting a parameter representing the total quantity of suction air inclusive of said supplementary air being supplied to said engine, said second sensor means being adapted to detect said parameter in synchronism with said predetermined engine rotational position signal.

3. The idling rpm feedback control system as claimed in claim 2, wherein said valve control means is adapted to start opening said control valve upon a lapse of such a period of time after each pulse of said predetermined engine rotational position signal has been supplied to said valve control means that said second sensor means can detect a central value of said parameter representing the total suction air quantity at the time of inputting of a pulse of said predetermined rotational position signal immediately following said each pulse thereof to said valve control means.

4. The idling rpm feedback control system as claimed in claim 3, wherein said parameter representing the total suction air quantity comprises absolute pressure in said intake passage of said engine.

5. The idling rpm feedback control system as claimed in claim 3, wherein said period of time is variable as a function of rpm of the engine.

6. The idling rpm feedback control system according to claim 3, wherein said period of time is set to such a value as to make the phase of the fluctuating cycle of said absolute pressure in said intake passage of said engine substantially constant relative to the timing of generation of each pulse of said predetermined engine rotational position signal.

* * * * *